US012092343B2

(12) United States Patent
Morikawa et al.

(10) Patent No.: US 12,092,343 B2
(45) Date of Patent: Sep. 17, 2024

(54) STORAGE WATER HEATER

(71) Applicant: Mitsubishi Electric Corporation, Tokyo (JP)

(72) Inventors: Akira Morikawa, Tokyo (JP); Masaki Toyoshima, Tokyo (JP); Noriaki Katsumata, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 18/265,688

(22) PCT Filed: Jan. 22, 2021

(86) PCT No.: PCT/JP2021/002298
§ 371 (c)(1),
(2) Date: Jun. 7, 2023

(87) PCT Pub. No.: WO2022/157940
PCT Pub. Date: Jul. 28, 2022

(65) Prior Publication Data

US 2024/0044515 A1 Feb. 8, 2024

(51) Int. Cl.
*F24D 17/00* (2022.01)

(52) U.S. Cl.
CPC ..... *F24D 17/0073* (2013.01)

(58) Field of Classification Search
CPC .. F24D 17/0073; F24D 17/0078; F24D 17/00; F24D 2220/044; F24D 19/1051; F24H 1/18
See application file for complete search history.

(56) References Cited

U.S. PATENT DOCUMENTS 4,936,289 A * 6/1990 Peterson ..... F24D 17/0078 122/13.3
2006/0230772 A1* 10/2006 Wacknov ..... F24D 17/0078 62/199

FOREIGN PATENT DOCUMENTS

DE 102008033063 A1 * 1/2010 ..... F24D 10/003
EP 3553409 A1 10/2019
(Continued)

OTHER PUBLICATIONS

English translation of JP-2009103362-A, dated Dec. 5, 2023 (Year: 2023).*
(Continued)

*Primary Examiner* — Edelmira Bosques
*Assistant Examiner* — Brett Peterson Mallon
(74) *Attorney, Agent, or Firm* — XSENSUS LLP

(57) ABSTRACT

A storage water heater is provided that allows for improved maintenance of hygiene in a lower part of a hot-water storage tank and in a passage connected to the lower part of the hot-water storage tank. A storage water heater includes a heating device, a hot-water storage tank, a first passage, and a controller. The hot-water storage tank stores hot water. The first passage is connected to a lower part of the hot-water storage tank. The controller is configured to selectively switch between a heat-up operation and a recirculation operation. In the heat-up operation, hot water heated by the heating device is delivered to an upper part of the hot-water storage tank. In the recirculation operation, hot water flowing out from the upper part of the hot-water storage tank is delivered to the lower part of the hot-water storage tank via the first passage.

14 Claims, 9 Drawing Sheets

(56) References Cited

FOREIGN PATENT DOCUMENTS

| | | | | |
|---|---|---|---|---|
| JP | 2004-218921 | A | | 8/2004 |
| JP | 2009-068825 | A | | 4/2009 |
| JP | 2009-092323 | A | | 4/2009 |
| JP | 2009103362 | A | * | 5/2009 |
| JP | 2011-117643 | A | | 6/2011 |
| JP | 2013-015290 | A | | 1/2013 |
| JP | 5894402 | B2 | | 3/2016 |
| JP | 2019-086216 | A | | 6/2019 |
| JP | 2019-138601 | A | | 8/2019 |
| JP | 6599026 | B2 | | 10/2019 |
| JP | 2020-064808 | A | | 4/2020 |
| JP | 6734450 | B2 | | 8/2020 |
| JP | 2020125878 | A | * | 8/2020 |
| KR | 101343445 | B1 | * | 12/2013 |

OTHER PUBLICATIONS

English translation of DE-102008033063-A1, dated Dec. 5, 2023 (Year: 2023).*

English translation of KR-101343445-B1, dated Dec. 5, 2023 (Year: 2023).*

English translation of JP-2020125878-A, dated Dec. 5, 2023 (Year: 2023).*

English-language translation of International Search Report and Written Opinion issued Mar. 9, 2021, in corresponding International Application No. PCT/JP2021/002298, 21pp.

International Search Report and Written Opinion mailed on Mar. 9, 2021, received for PCT Application PCT/JP2021/002298, filed on Jan. 22, 2021, 12 pages including English Translation.

* cited by examiner

STORAGE WATER HEATER

CROSS-REFERENCE TO RELATED APPLICATION

The present application is based on PCT filing PCT/JP2021/002298, filed Jan. 22, 2021, the entire contents of which are incorporated herein by reference.

TECHNICAL FIELD

The present disclosure relates to a storage water heater.

BACKGROUND ART

Some storage water heater executes a heat-up operation by drawing hot water in a hot-water storage tank from the bottom part of the hot-water storage tank, heating the hot water to a high temperature through a heat-pump heating means, and then returning the high-temperature hot water to the top part of the hot-water storage tank (e.g., Patent Literature 1).

In such a storage water heater, the heat-up operation causes high-temperature hot water to be stored gradually from the top part of the hot-water storage tank. In the hot-water storage tank, low-temperature hot water and high-temperature hot water are stored in layers such that the low-temperature hot water with its large density accumulates in the lower part and the high-temperature hot water with its small density accumulates in the upper part. The temperature of hot water is thus lower in the lower part of the hot-water storage tank than in the upper part. In particular, when tap water is supplied to the hot-water storage tank upon supply of hot water to an external location, temperature is caused to drop in areas such as the lower part of the hot-water storage tank and the interior of a pipe located in a passage connected to the lower part of the hot-water storage tank. Such areas with decreased temperature provide an environment conducive to microbial growth. This makes it difficult to ensure long-term maintenance of hygiene.

CITATION LIST

Patent Literature

Patent Literature 1: Japanese Patent No. 6599026

SUMMARY OF INVENTION

Technical Problem

The present disclosure is directed to addressing the above-mentioned problem. Accordingly, the present disclosure provides a storage water heater that prevents an environment conducive to microbial growth from being created in the lower part of the hot-water storage tank and in a passage connected to the lower part of the hot-water storage tank and that consequently ensures long-term maintenance of hygiene.

Solution to Problem

A storage water heater according to an embodiment of the present disclosure includes a heating device, a hot-water storage tank, a first passage, and a controller. The hot-water storage tank stores hot water. The first passage is connected to a lower part of the hot-water storage tank. The controller is configured to selectively switch between a heat-up operation and a recirculation operation. In the heat-up operation, hot water flowing out from the hot-water storage tank is delivered to the heating device via the first passage and then hot water heated by the heating device is delivered to an upper part of the hot-water storage tank. In the recirculation operation, hot water flowing out from the upper part of the hot-water storage tank is delivered to the lower part of the hot-water storage tank via the first passage.

Advantageous Effects of Invention

With the storage water heater according to an embodiment of the present disclosure, hot water flowing out from the upper part of the hot-water storage tank is delivered to the lower part of the hot-water storage tank. This makes it possible to inhibit microbial growth and to improve maintenance of hygiene in the lower part of the hot-water storage tank and in a passage connected to the lower part of the hot-water storage tank.

DESCRIPTION OF EMBODIMENTS

Figure 1:
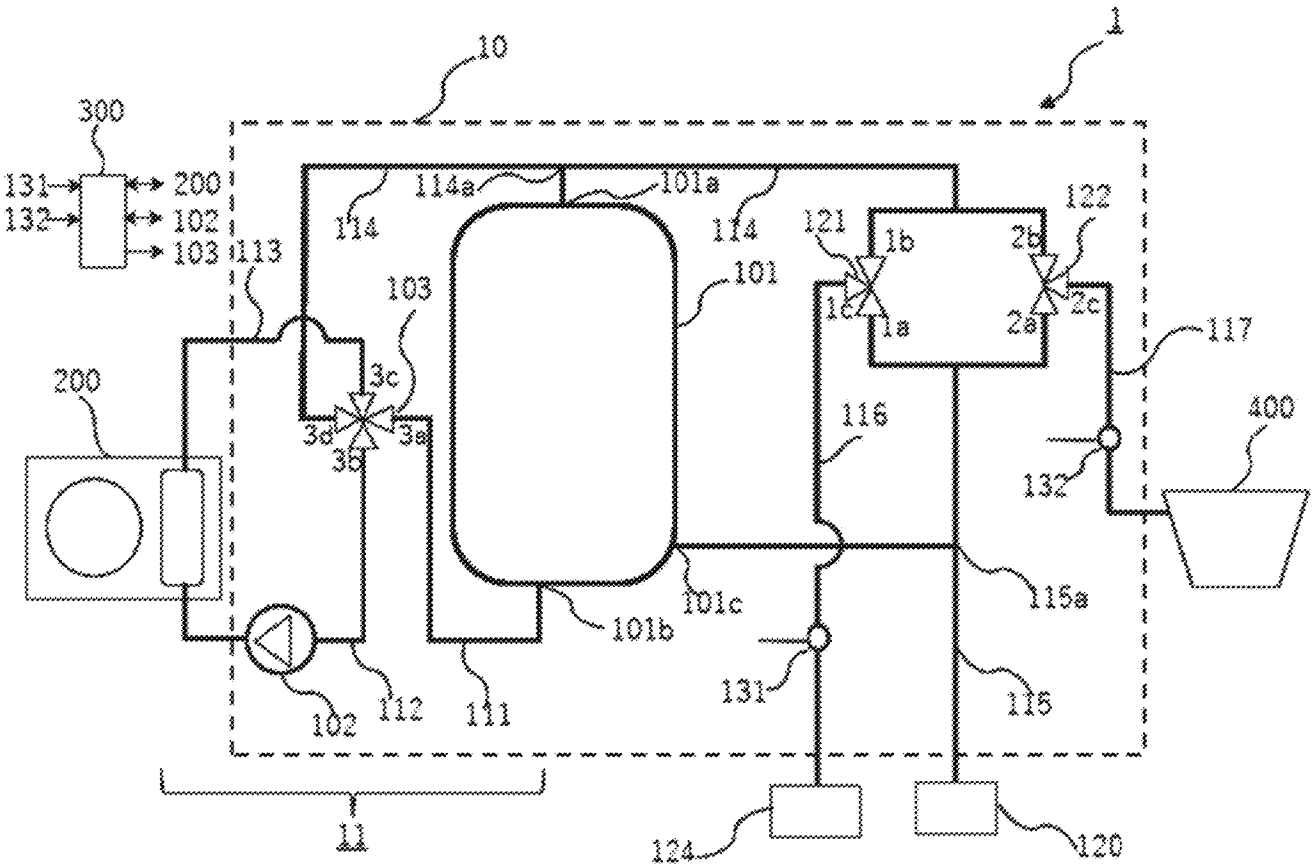
FIG. 1 is a configuration diagram of a storage water heater according to Embodiment 1 of the present disclosure.

Embodiments of the present disclosure are described below with reference to the drawings. In the drawings used herein, the same elements are provided with the same reference signs. The present disclosure is not limited to the embodiments below but may be variously modified without departing from the gist of the present disclosure.

Embodiment 1

<Configuration of Storage Water Heater>

FIG. 1 is a configuration diagram of a storage water heater 1 according to Embodiment 1 of the present disclosure. The storage water heater 1 is roughly divided into the following units: a hot-water storage unit 10, a heat pump unit 200, and a controller 300. The hot-water storage unit 10 is represented by an area surrounded by a dotted line illustrated in FIG. 1. The following components are connected to the storage water heater 1: a bathtub 400, a hot-water supply end 124 through which warm water is supplied to an external location, and a water supply end 120 through which tap water is supplied from an external location.

The storage water heater 1 stores hot water heated by the heat pump unit 200, which is a heating device, into a hot-water storage tank 101 of the hot-water storage unit 10.

The heat pump unit 200 includes, for example, the following components (not illustrated): a compressor, a water-to-refrigerant heat exchanger, an expansion valve, and an air heat exchanger. These components are connected in a loop to form a refrigeration cycle circuit in which refrigerant is to be circulated.

Although the following description is directed to an exemplary case where the heating device is the heat pump unit 200, the heating device may be a combustion heater that heats water through combustion of a fuel such as gas and oil.

The hot-water storage tank 101 serves to store hot water. The hot-water storage tank 101 includes a first inlet-outlet port 101*a*, and a second inlet-outlet port 101*b*. In the vertical direction corresponding to the up-and-down direction illustrated in FIG. 1, the first inlet-outlet port 101*a* is located in an upper part of the hot-water storage tank 101, and the second inlet-outlet port 101*b* is located in a lower part of the hot-water storage tank 101. As used herein, the expression "upper part of the hot-water storage tank 101" is not limited to the top part of the hot-water storage tank 101 but includes a range of height positions in the vicinity of the top part. As used herein, the expression "lower part of the hot-water storage tank 101" is not limited to the bottom part of the hot-water storage tank 101 but includes a range of height positions in the vicinity of the bottom part. In the example illustrated in FIG. 1, the first inlet-outlet port 101*a* is located in the top part of the hot-water storage tank 101, and the second inlet-outlet port 101*b* is located in the bottom part of the hot-water storage tank 101.

The hot-water storage tank 101 further includes a water supply port 101*c* located in the lower part of the hot-water storage tank 101 and through which tap water is supplied. Although the water supply port 101*c* is located in the lower part of the hot-water storage tank 101 in the example illustrated in FIG. 1, the water supply port 101*c* is not necessarily located in the lower part of the hot-water storage tank 101.

A passage 11 connects the upper and lower parts of the hot-water storage tank 101. The passage 11 includes the following passages in a location external to the hot-water storage tank 101: a first passage 111, a second passage 112, a third passage 113, and a fourth passage 114. Each of the first to fourth passages 111 to 114 is in the form of, for example, a pipe that delivers hot water. A circulation pump 102, a four-way valve 103, and the heat pump unit 200 are disposed in the passage 11.

The storage water heater 1 selectively switches between and executes a heat-up operation and a recirculation operation. A heat-up operation is executed by, through activation of the circulation pump 102, causing hot water to flow out from the second inlet-outlet port 101*b* located in the lower part of the hot-water storage tank 101 into the passage 11, supplying the hot water, which has flowed out, toward an inlet portion of the heat pump unit 200 disposed in the passage 11, and then delivering, to the first inlet-outlet port 101*a* located in the upper part of the hot-water storage tank 101, hot water heated by the heat pump unit 200 and flowing out from an outlet portion of the heat pump unit 200.

A recirculation operation is executed by, through activation of the circulation pump 102, routing hot water flowing out from the first inlet-outlet port 101*a*, which is located in the upper part of the hot-water storage tank 101, through the passage 11 for delivery to the second inlet-outlet port 101*b*, which is located in the lower part of the hot-water storage tank 101. The controller 300 selectively switches between the heat-up operation and the recirculation operation mentioned above, and controls how a switching unit described later, the circulation pump 102, and the heat pump unit 200 operate during each of these operations. Details of the heat-up operation and the recirculation operation will be given later.

The heat-up operation and the recirculation operation differ from each other in the direction of hot water delivery but cause hot water to be routed through the same passage 11. It is to be noted, however, that in an example described later, the heat-up operation and the recirculation operation differ from each other in the order in which hot water flows through the four passages (the first to fourth passages 111 to 114) included in the passage 11. The four-way valve 103 is disposed in the passage 11. The four-way valve 103 serves as a switching unit that, by switching which other passage each one of the four passages (the first to fourth passages 111 to 114) communicates with, switches in what order hot water flows through the four passages. The circulation pump 102 is activated in each of the heat-up operation and the recirculation operation to pass hot water through the passage 11. In an alternative arrangement, another circulation device may be provided such that the circulation pump 102 is activated during only one of the heat-up operation and the recirculation operation, and the other circulation device is activated during the other operation.

The four-way valve 103 includes four water inlet-outlet ports through which hot water flows in and out. The four water inlet-outlet ports include a first water inlet-outlet port 3*a*, a second water inlet-outlet port 3*b*, a third water inlet-outlet port 3*c*, and a fourth water inlet-outlet port 3*d*. The first passage 111 connects the first water inlet-outlet port 3*a* of the four-way valve 103 with the second inlet-outlet port 101*b* located in the lower part of the hot-water storage tank 101. The second passage 112 connects the second water inlet-outlet port 3*b* of the four-way valve 103 with the hot-water inlet portion of the heat pump unit 200. The third passage 113 connects the third water inlet-outlet port 3*c* of the four-way valve 103 with the hot-water outlet portion of the heat pump unit 200. The fourth passage 114 connects the fourth water inlet-outlet port 3*d* of the four-way valve 103 with the first inlet-outlet port 101*a* located in the upper part of the hot-water storage tank 101. The fourth passage 114 includes a branch part 114*a* located at a point in the fourth passage 114. The fourth passage 114 is thus connected to not only the first inlet-outlet port 101*a* located in the upper part of the hot-water storage tank 101, but also to an inlet 1*b* of a mixing valve 121 described later and an inlet 2*b* of a mixing valve 122 described later.

Although the circulation pump 102 is illustrated in FIG. 1 as being disposed in the second passage 112, the location of the circulation pump 102 is not limited to this location. Alternatively, the circulation pump 102 may be disposed in the third passage 113. Activation of the circulation pump 102 causes a flow of hot water to be formed. The flow of hot water travels from the hot-water inlet portion of the heat pump unit 200 toward the hot-water outlet portion of the heat pump unit 200.

In the hot-water storage unit 10, tap water is supplied from the water supply end 120 into the hot-water storage tank 101 through the water supply port 101*c* located in the lower part of the hot-water storage tank 101. The water supply end 120 is connected to the water supply port 101*c* via a fifth passage 115 and via a branch part 115*a*, which is located at a point in the fifth passage 115. The fifth passage 115 is in the form of, for example, a pipe that delivers water.

To the water supply end 120, the mixing valve 121 and the mixing valve 122 are connected. The mixing valve 121 includes inlets 1*a* and 1*b*, and an outlet 1*c*. The mixing valve 122 includes inlets 2*a* and 2*b*, and an outlet 2*c*.

The water supply end 120 is connected via the branch part 115*a*, which is located at a point in the fifth passage 115, to the inlet 1*a* of the mixing valve 121 and to the inlet 2*a* of the mixing valve 122. The inlet 1*b* of the mixing valve 121, and the inlet 2*b* of the mixing valve 122 are each connected via the fourth passage 114 to the first inlet-outlet port 101*a* of the hot-water storage tank 101 and to the fourth water inlet-outlet port 3*d* of the four-way valve 103.

The outlet 1*c* of the mixing valve 121 is connected via a sixth passage 116 to the hot-water supply end 124. A thermistor 131 is disposed at a point in the sixth passage 116. The thermistor 131 serves as a warm-water-temperature detection unit that detects the temperature of warm water that is supplied to the hot-water supply end 124.

The outlet 2*c* of the mixing valve 122 is connected via a seventh passage 117 to the bathtub 400. A thermistor 132 is disposed at a point in the seventh passage 117. The thermistor 132 serves as a warm-water-temperature detection unit that detects the temperature of warm water that is supplied to the bathtub 400. The measurement results obtained by the thermistor 131 and the thermistor 132 are sent to the controller 300. The sixth passage 116 and the seventh passage 117 are each in the form of, for example, a pipe that delivers warm water.

<Heat-Up Operation>

A heat-up operation to be performed by the storage water heater 1 according to Embodiment 1 is described below with reference to FIG. 2.

An exemplary heat-up operation is described below in which hot water drawn from the lower part of the hot-water storage tank 101 is heated by the heat pump unit 200 disposed in the passage 11 before the hot water is delivered to the upper part of the hot-water storage tank 101. In FIG. 2, solid arrows represent how hot water flows through the passage 11 and the four-way valve 103 during the heat-up operation.

The controller 300 controls the four-way valve 103 such that, in executing the heat-up operation, the four-way valve 103 causes the first water inlet-outlet port 3*a* to communicate with the second water inlet-outlet port 3*b*, and causes the third water inlet-outlet port 3*c* to communicate with the fourth water inlet-outlet port 3*d*. At this time, the four-way valve 103 is switched to a heat-up operation state in which the first passage 111 and the second passage 112 communicate with each other and in which the third passage 113 and the fourth passage 114 communicate with each other.

With the four-way valve 103 controlled in this manner, the controller 300 activates the circulation pump 102. Consequently, in the passage 11, hot water is sequentially introduced from the second inlet-outlet port 101*b*, which is located in the lower part of the hot-water storage tank 101, to the first passage 111, the first water inlet-outlet port 3*a* of the four-way valve 103, the second water inlet-outlet port 3*b*, the second passage 112, the circulation pump 102, the heat pump unit 200, the third passage 113, the third water inlet-outlet port 3*c* of the four-way valve 103, the fourth water inlet-outlet port 3*d*, the fourth passage 114, and then to the first inlet-outlet port 101*a*, which is located in the upper part of the hot-water storage tank 101.

The controller 300 controls the heat pump unit 200 such that the heat pump unit 200 heats hot water flowing into the inlet portion of the heat pump unit 200, and causes the heated hot water to flow out toward the outlet portion of the heat pump unit 200.

In this manner, a heat-up operation is executed, in which hot water drawn from the lower part of the hot-water storage tank 101 is heated by the heat pump unit 200 serving as a heating device and then the heated hot water is delivered to the upper part of the hot-water storage tank 101. For example, the hot water to be delivered to the hot-water storage tank 101 is heated in the heat pump unit 200 to a temperature of 45 degrees C. or above.

Figure 2:
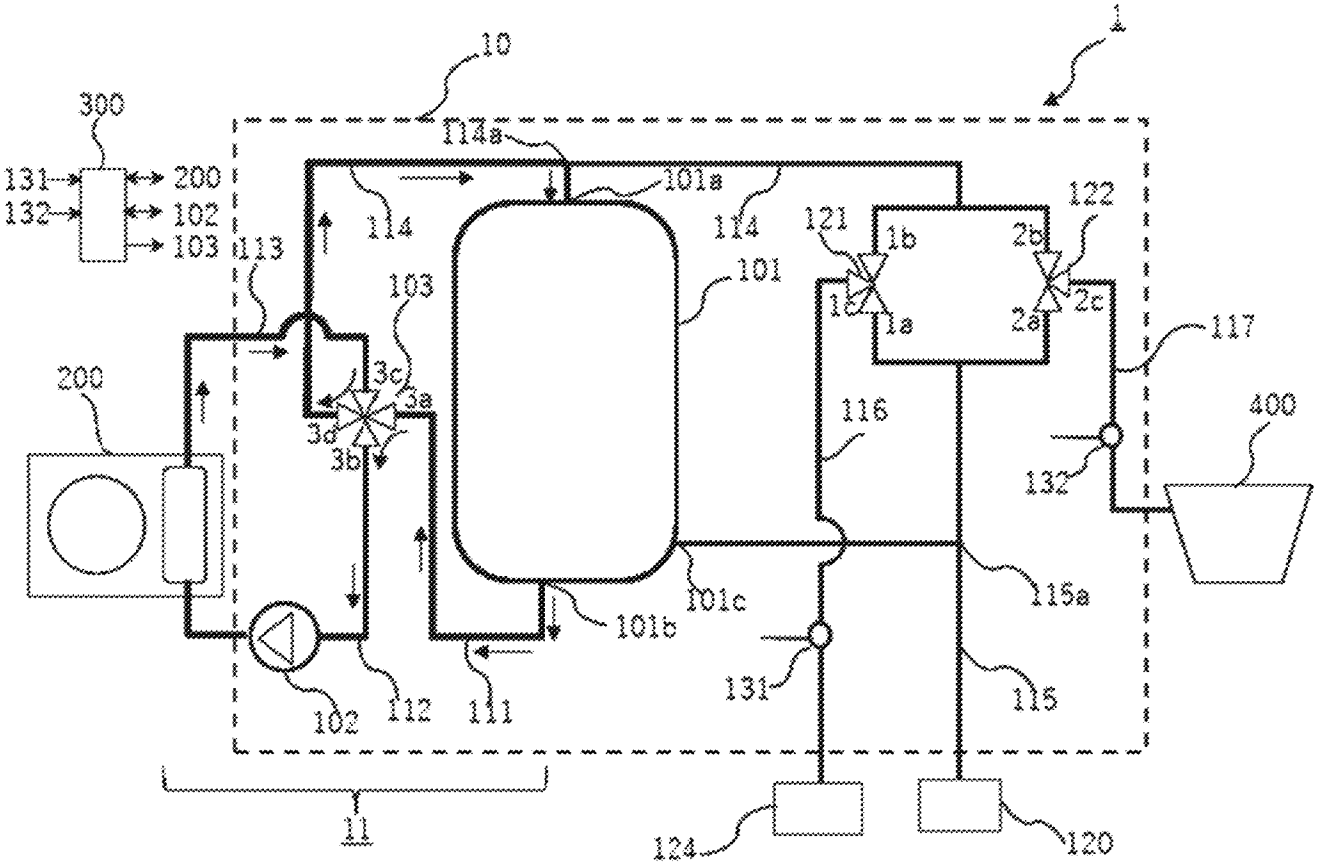
FIG. 2 illustrates a heat-up operation performed by the storage water heater according to Embodiment 1 of the present disclosure.

Through the heat-up operation mentioned above, in the up-and-down direction of the hot-water storage tank 101 illustrated in FIG. 2, hot water at high temperature is gradually stored into the hot-water storage tank 101 from the upper part of the hot-water storage tank 101 as a layer over hot water at low temperature located in the lower part.

<Recirculation Operation>

A recirculation operation to be performed by the storage water heater 1 according to Embodiment 1 is described below with reference to FIG. 3.

When hot water is to be used at the bathtub 400 or the hot-water supply end 124 after the heat-up operation mentioned above, hot water flowing out from the first inlet-outlet port 101*a* in the upper part of the hot-water storage tank 101 passes through the fourth passage 114, where the hot water is mixed at the mixing valve 121 or the mixing valve 122 with tap water supplied from the water supply end 120. The hot water is thus adjusted in temperature, and supplied to the hot-water supply end 124 or the bathtub 400 as warm water. As warm water is supplied to an external location in this manner, tap water is supplied via the fifth passage 115 from the water supply end 120 into the hot-water storage tank 101 through the water supply port 101*c*. In FIG. 3, the direction of flow of tap water supplied from the water supply end 120 to the hot-water storage tank 101 is represented by alternate long and short dashed arrows.

Tap water is usually colder and denser than the hot water in the hot-water storage tank 101, and thus accumulates in the lower part of the hot-water storage tank 101. This causes the temperature of hot water to decrease in the lower part of the hot-water storage tank 101. Typically, microorganisms such as bacteria and fungi thrive at temperatures between 20 and 40 degrees C. Accordingly, when hot water is maintained at a temperature between 20 to 40 degrees C., a build-up of microbial cells or microorganisms deposits as a biofilm attached at locations such as on the bottom and wall surface of the hot-water storage tank 101 and on the interior of a passage connected to the lower part of the hot-water storage tank 101. Attachment of microorganisms, biofilms, or other contaminants makes it difficult to keep hot water hygienic. The storage water heater 1 according to Embodiment 1 executes the recirculation operation to maintain hygiene by inhibiting microbial growth in the lower part of the hot-water storage tank 101 and in the passage 11, which is connected from the lower part of the hot-water storage tank 101 to the upper part of the hot-water storage tank 101. In particular, the hygiene in the pipe of the first passage 111 connected to the lower part of the hot-water storage tank 101 is improved.

Figure 3:
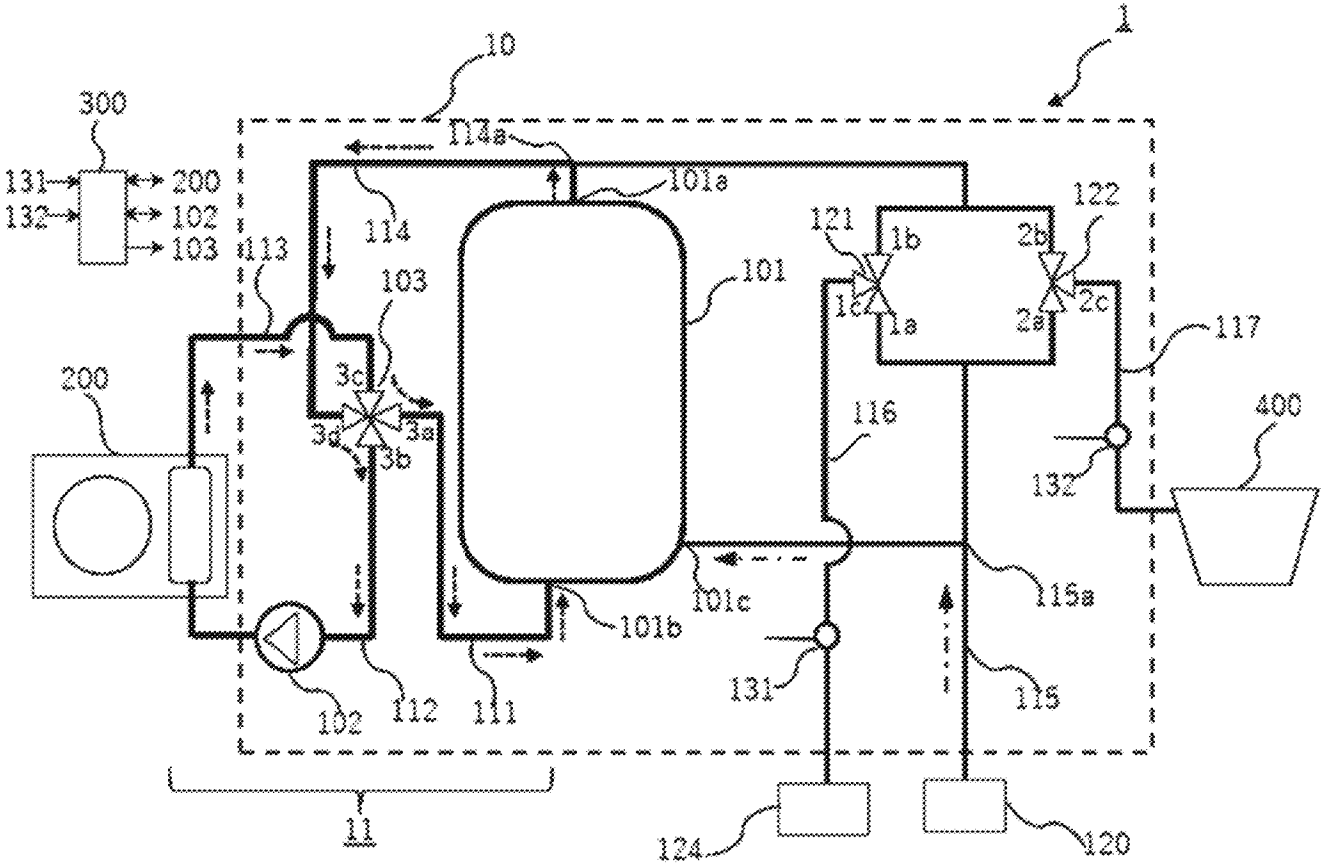
FIG. 3 illustrates a recirculation operation performed by the storage water heater according to Embodiment 1 of the present disclosure.

In FIG. 3, dotted arrows represent how hot water flows through the passage 11 and the four-way valve 103 during the recirculation operation.

The controller 300 controls the four-way valve 103 such that, in executing the recirculation operation, the four-way valve 103 causes the second water inlet-outlet port 3*b* to communicate with the fourth water inlet-outlet port 3*d*, and causes the first water inlet-outlet port 3*a* to communicate with the third water inlet-outlet port 3*c*. At this time, the four-way valve 103 is switched to a recirculation operation state in which the fourth passage 114 and the second passage 112 communicate with each other and in which the third passage 113 and the first passage 111 communicate with each other.

With the four-way valve 103 controlled in this manner, the controller 300 activates the circulation pump 102. Consequently, in the passage 11, hot water is sequentially introduced from the first inlet-outlet port 101*a*, which is located in the upper part of the hot-water storage tank 101, to the fourth passage 114, the fourth water inlet-outlet port 3*d* of the four-way valve 103, the second water inlet-outlet port 3*b*, the second passage 112, the circulation pump 102, the heat pump unit 200, the third passage 113, the third water inlet-outlet port 3*c* of the four-way valve 103, the first water inlet-outlet port 3*a*, the first passage 111, and then to the second inlet-outlet port 101*b*, which is located in the lower part of the hot-water storage tank 101.

In this manner, hot water drawn from the upper part of the hot-water storage tank 101 is delivered to the lower part of the hot-water storage tank 101.

At this time, the controller 300 stops heating performed by the heat pump unit 200 disposed in the passage 11, and allows only passage of water through the heat pump unit 200. In this manner, a recirculation operation is executed in which high-temperature hot water drawn from the upper part of the hot-water storage tank 101 is delivered to and circulated in the lower part of the hot-water storage tank 101. Executing such a recirculation operation causes the temperature in the lower part of the hot-water storage tank 101 to rise to a temperature that limits microbial growth. The recirculation operation also makes it possible to sterilize under high temperature, or disinfect under running water, the interiors of the following components disposed in the passage 11 connected from the lower part of the hot-water storage tank 101 to the upper part of the hot-water storage tank 101: the first passage 111, the second passage 112, the third passage 113, the fourth passage 114, the four-way valve 103, the circulation pump 102, and the heat pump unit 200.

At this time, high-temperature hot water drawn from the upper part of the hot-water storage tank 101 is used. This makes it possible to efficiently maintain, in an energy-saving manner without use of a heating device, the hygiene in the lower part of the hot-water storage tank 101 and in the passage 11, which is connected from the lower part of the hot-water storage tank 101 to the upper part of the hot-water storage tank 101.

In addition, the storage water heater 1 executes a recirculation operation in which hot water drawn from the upper part of the hot-water storage tank 101 is delivered to the lower part of the hot-water storage tank 101. This helps to improve the uniformity of hot water temperature in the hot-water storage tank 101, and mitigate a decrease in hot water temperature in the lower part of the hot-water storage tank.

If the hot water in the upper part of the hot-water storage tank 101 has dropped in temperature, to increase sterilization effect, the controller 300 may, in executing the recirculation operation, activate the heat pump unit 200 so that hot water drawn from the upper part of the hot-water storage tank 101 is heated before the hot water is delivered to the lower part of the hot-water storage tank 101. Even through the heating device is used in this case, the hot water from the upper part of the hot-water storage tank 101 has a higher temperature than the hot water in the lower part of the hot-water storage tank 101, and thus is heated with comparatively less energy. This allows hygiene to be efficiently maintained in an energy-saving manner in the lower part of the hot-water storage tank 101 and in the passage 11, which is connected from the lower part of the hot-water storage tank 101 to the upper part of the hot-water storage tank 101.

The controller 300 is configured to cause the above-mentioned recirculation operation to be executed, for example, at regular intervals when high-temperature hot water is stored in the upper part of the hot-water storage tank 101. Alternatively, the controller 300 may be configured to cause the recirculation operation to be executed when, after the heat-up operation, no hot water is used and thus no tap water is supplied. Whether hot water has been used is determined by the controller 300 through, for example, transmission of measurement results to the controller 300, the measurement results including a measurement result of hot water temperature obtained by a water temperature meter (not illustrated) in the hot-water storage tank 101 and measurement results obtained by the thermistor 131 and the thermistor 132.

The controller 300 may be configured to perform the recirculation operation immediately after the heat-up operation. Immediately after the hating-up operation, hot water in the hot-water storage tank 101 may have a temperature difference between the upper and lower parts of the hot-water storage tank 101. To decrease such a difference, executing the recirculation operation immediately after the heat-up operation makes it possible to mitigate a decrease in hot water temperature in the lower part of the hot-water storage tank 101. This makes it possible to sterilize under high temperature, or disinfect under running water, the lower part of the hot-water storage tank 101 and the interior of the passage 11, which is connected from the lower part of the hot-water storage tank 101 to the upper part of the hot-water storage tank 101.

The storage water heater according to Embodiment 1 executes a recirculation operation in which, after the heat-up operation, hot water drawn from the upper part of the hot-water storage tank is delivered to the lower part of the hot-water storage tank. This makes it possible to, in an energy-saving manner, efficiently inhibit microbial growth and improve the maintenance of hygiene in the lower part of the hot-water storage tank and in a passage connected to the lower part of the hot-water storage tank.

The recirculation operation mentioned above also helps to improve the uniformity of hot water temperature in the hot-water storage tank, and mitigate a decrease in hot water temperature in the lower part of the hot-water storage tank.

Embodiment 2

In the following description of Embodiment 2, components or elements identical to those according to Embodiment 1 of the present disclosure are provided with the same reference signs, and features identical or corresponding to those according to Embodiment 1 are not described. A storage water heater 2 according to Embodiment 2 is described below with reference to the drawings.

Figure 4:
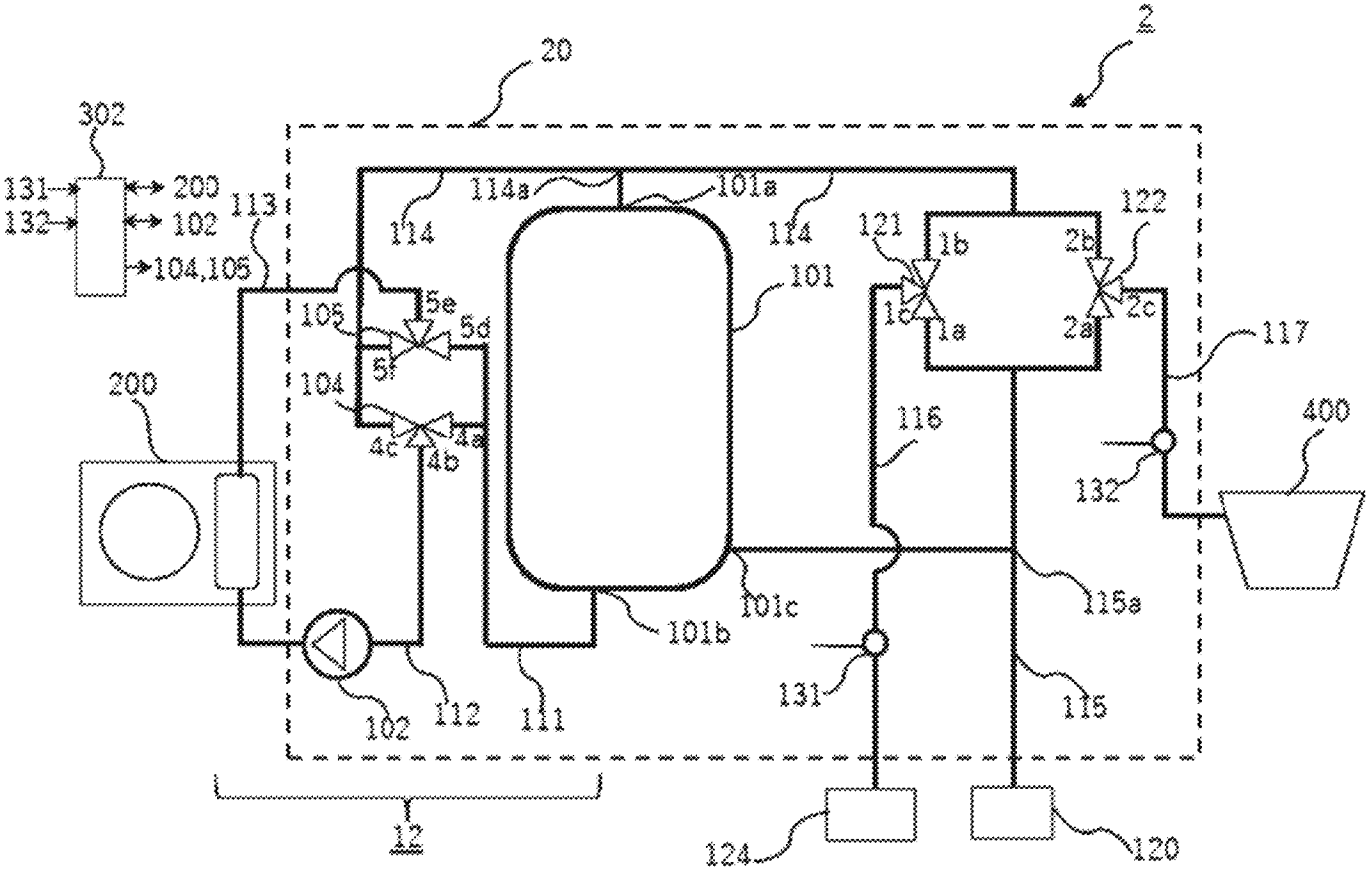
FIG. 4 is a configuration diagram of a storage water heater according to Embodiment 2 of the present disclosure.

FIG. 4 is a configuration diagram of the storage water heater 2 according to Embodiment 2 of the present disclosure. The storage water heater 1 according to Embodiment 1 illustrated in FIG. 1 employs the four-way valve 103 serving as a switching unit to switch between the heat-up operation and the recirculation operation. By contrast, the storage water heater 2 according to Embodiment 2 includes a hot-water storage unit 20 (represented by an area surrounded by a dotted line illustrated in FIG. 4) in which two three-way valves, which are a three-way valve 104 and a three-way valve 105, are each employed as a switching unit.

As illustrated in FIG. 4, the storage water heater 2 includes a passage 12 that connects the first inlet-outlet port 101*a*, which is located in the upper part of the hot-water storage tank 101, with the second inlet-outlet port 101*b*, which is located in the lower part of the hot-water storage tank 101.

The passage 12 connecting the upper and lower parts of the hot-water storage tank 101 includes the following passages in a location external to the hot-water storage tank 101: the first passage 111, the second passage 112, the third passage 113, and the fourth passage 114. The circulation pump 102, the three-way valve 104, the three-way valve 105, and the heat pump unit 200 are disposed in the passage 12.

The storage water heater 2 according to Embodiment 2 includes a controller 302. The controller 302 selectively switches between the heat-up operation and the recirculation operation, and controls how the switching unit (the three-way valve 104 and the three-way valve 105), the circulation pump 102, and the heat pump unit 200 operate during each of these operations.

The three-way valve 104 and the three-way valve 105 each include three water inlet-outlet ports through which hot water flows in and out. The three-way valve 104 includes a first water inlet-outlet port 4*a*, a second water inlet-outlet port 4*b*, and a third water inlet-outlet port 4*c*. The three-way valve 105 includes a first water inlet-outlet port 5*d*, a second water inlet-outlet port 5*e*, and a third water inlet-outlet port 5*f*.

The first water inlet-outlet port 4*a* of the three-way valve 104 and the first water inlet-outlet port 5*d* of the three-way valve 105 are connected to the first passage 111. The first water inlet-outlet port 4*a* and the first water inlet-outlet port 5*d* are thus connected via the first passage 111 to the second inlet-outlet port 101*b* located in the lower part of the hot-water storage tank 101.

The second water inlet-outlet port 4*b* of the three-way valve 105 is connected to the second passage 112. The second water inlet-outlet port 4*b* is thus connected via the circulation pump 102 to the hot-water inlet portion of the heat pump unit 200. The second water inlet-outlet port 5*e* of the three-way valve 105 is connected to the third passage 113. The second water inlet-outlet port 5*e* is thus connected via the third passage 113 to the hot-water outlet portion of the heat pump unit 200.

The third water inlet-outlet port 4*c* of the three-way valve 104 and the third water inlet-outlet port 5*f* of the three-way valve 105 are both connected to the fourth passage 114. The third water inlet-outlet port 4*c* and the third water inlet-outlet port 5*f* are thus connected, via the fourth passage 114 and via the branch part 114*a* located at a point in the fourth passage 114, to the first inlet-outlet port 101*a* located in the upper part of the hot-water storage tank 101.

<Heat-Up Operation>

Figure 5:
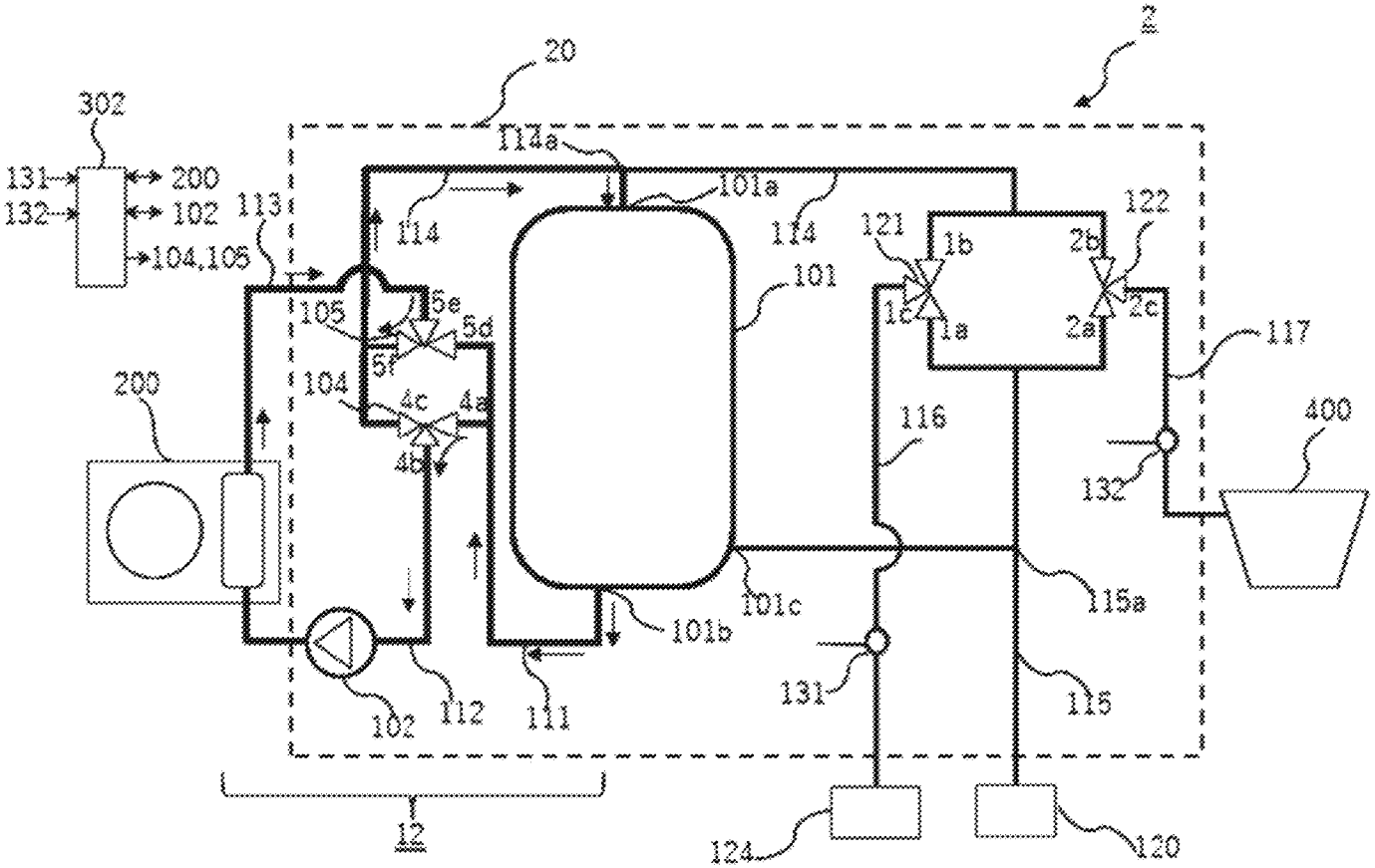
FIG. 5 illustrates a heat-up operation performed by the storage water heater according to Embodiment 2 of the present disclosure.

A heat-up operation to be performed by the storage water heater 2 according to Embodiment 2 is described below with reference to FIG. 5.

An exemplary heat-up operation is described below in which hot water drawn from the lower part of the hot-water storage tank 101 is routed through the passage 12 and heated by the heat pump unit 200 before the hot water is delivered to the upper part of the hot-water storage tank 101. In FIG. 5, solid arrows represent how hot water flows through the passage 12, the three-way valve 104, and the three-way valve 105 during execution of the heat-up operation.

In executing the heat-up operation, the controller 302 controls the three-way valve 104 and the three-way valve 105 such that the first water inlet-outlet port 4*a* and the second water inlet-outlet port 4*b* of the three-way valve 104 communicate with each other, and that the second water inlet-outlet port 5*e* and the third water inlet-outlet port of the three-way valve 105 communicate with each other. At this time, the three-way valve 104 and the three-way valve 105 are switched to a heat-up operation state in which the first passage 111 and the second passage 112 communicate with each other and in which the third passage 113 and the fourth passage 114 communicate with each other.

With the three-way valve 104 and the three-way valve 105 controlled in this manner, the controller 302 activates the circulation pump 102. Consequently, in the passage 12, hot water is sequentially introduced from the second inlet-outlet port 101*b*, which is located in the lower part of the hot-water storage tank 101, to the first passage 111, the first water inlet-outlet port 4*a* of the three-way valve 104, the second water inlet-outlet port 4*b*, the second passage 112, the circulation pump 102, the heat pump unit 200, the third passage 113, the second water inlet-outlet port 5*e* of the three-way valve 105, the third water inlet-outlet port 5*f*, the fourth passage 114, and then to the first inlet-outlet port 101*a*, which is located in the upper part of the hot-water storage tank 101.

The controller 302 controls the heat pump unit 200 such that the heat pump unit 200 heats hot water flowing into the inlet portion of the heat pump unit 200, and causes the heated hot water to flow out toward the outlet portion of the heat pump unit 200.

In this manner, a heat-up operation is executed in which hot water drawn from the lower part of the hot-water storage tank 101 is heated by the heat pump unit 200 serving as a heating device and then the heated hot water is delivered to the upper part of the hot-water storage tank 101.

Through the heat-up operation mentioned above, in the up-and-down direction of the hot-water storage tank 101, hot water at high temperature is gradually stored into the hot-water storage tank 101 from the upper part of the hot-water storage tank 101 as a layer over hot water at low temperature located in the lower part.

<Recirculation Operation>

Figure 6:
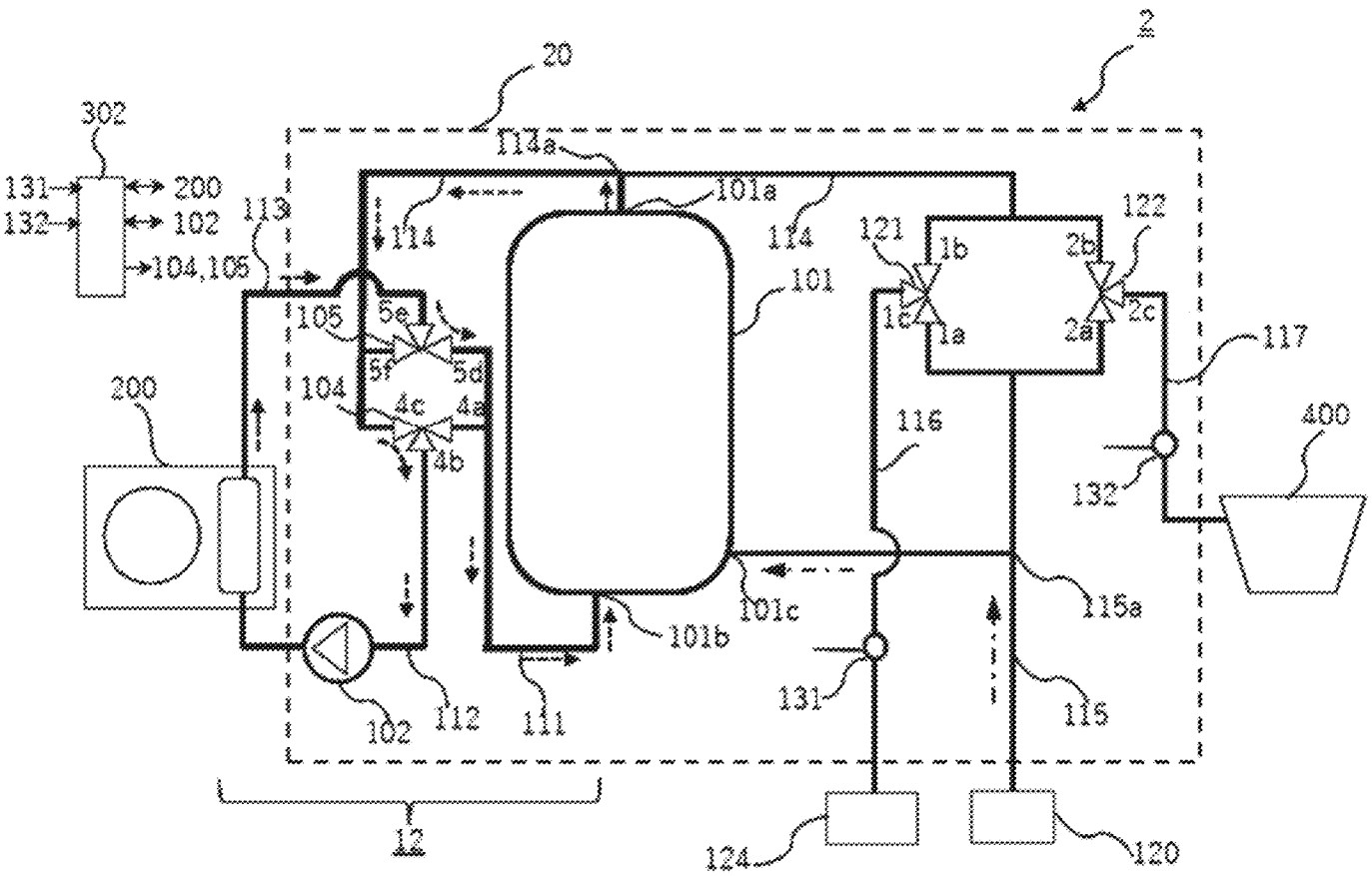
FIG. 6 illustrates a recirculation operation performed by the storage water heater according to Embodiment 2 of the present disclosure.

A recirculation operation to be performed by the storage water heater 2 according to Embodiment 2 is described below with reference to FIG. 6.

The storage water heater 2 according to Embodiment 2 operates in substantially the same manner as with Embodiment 1 when hot water is to be used at the bathtub 400 or the hot-water supply end 124 after the heat-up operation mentioned above. That is, hot water drawn from the first inlet-outlet port 101*a* in the upper part of the hot-water storage tank 101 is routed through the fourth passage 114, where the hot water is mixed at the mixing valve 121 or the mixing valve 122 with tap water supplied from the water supply end 120. The hot water thus becomes warm water, which is then supplied to the hot-water supply end 124 or the bathtub 400. In this case, as the warm water obtained by the mixing is supplied to an external location, tap water is supplied via the fifth passage 115 from the water supply end 120 into the hot-water storage tank 101 through the water supply port 101*c*. In FIG. 6, the direction of flow of tap water from the water supply end 120 to the hot-water storage tank 101 is represented by alternate long and short dashed arrows.

After the heat-up operation, a recirculation operation is executed in which hot water drawn from the upper part of the hot-water storage tank 101 is delivered to the lower part of the hot-water storage tank 101.

In the recirculation operation performed by the storage water heater 2 as well, hot water is routed through the passage 12. In FIG. 6, dotted arrows represent how hot water flows during execution of the recirculation operation through the first to fourth passages 111 to 114, the three-way valve 104, and the three-way valve 105, which are disposed in the passage 12.

In executing the recirculation operation, the controller 302 controls the three-way valve 104 and the three-way valve 105 such that the second water inlet-outlet port 4*b* and the third water inlet-outlet port 4*c* of the three-way valve 104 communicate with each other, and that the first water inlet-outlet port 5*d* and the second water inlet-outlet port 5*e* of the three-way valve 105 communicate with each other. At this time, the three-way valve 104 and the three-way valve 105 are switched to a recirculation operation state in which the fourth passage 114 and the second passage 112 communicate with each other and in which the third passage 113 and the first passage 111 communicate with each other.

With the three-way valve 104 and the three-way valve 105 controlled in this manner, the controller 302 activates the circulation pump 102. Consequently, in the passage 12, hot water is sequentially introduced from the first inlet-outlet port 101*a*, which is located in the upper part of the hot-water storage tank 101, to the fourth passage 114, the third water inlet-outlet port 4*c* of the three-way valve 104, the second water inlet-outlet port 4*b*, the second passage 112, the circulation pump 102, the heat pump unit 200, the third passage 113, the second water inlet-outlet port 5*e* of the three-way valve 105, the first water inlet-outlet port 5*d*, the first passage 111, and then to the second inlet-outlet port 101*b*, which is located in the lower part of the hot-water storage tank 101.

In this manner, hot water drawn from the upper part of the hot-water storage tank 101 is delivered to the lower part of the hot-water storage tank 101.

At this time, the controller 302 causes the heat pump unit 200 to stop heating, and allows only passage of water through the heat pump unit 200. In this manner, a recirculation operation is executed in which high-temperature hot water drawn from the upper part of the hot-water storage tank 101 is delivered to and circulated in the lower part of the hot-water storage tank 101. Executing such a recirculation operation causes the temperature in the lower part of the hot-water storage tank 101 to rise to a temperature that limits microbial growth. The recirculation operation also makes it possible to sterilize under high temperature, or disinfect under running water, the interiors of the following components disposed in the passage 12 connected from the lower part of the hot-water storage tank 101 to the upper part of the hot-water storage tank 101: the first passage 111, the second passage 112, the third passage 113, the fourth passage 114, the three-way valve 104, the three-way valve 105, the circulation pump 102, and the heat pump unit 200.

As with Embodiment 1, in executing the recirculation operation mentioned above, the heat pump unit 200 is activated to deliver hot water drawn from the upper part of the hot-water storage tank 101 to the lower part of the hot-water storage tank 101. This allows for improved sterilization effect.

Embodiment 3

In the following description of Embodiment 3, components or elements identical to those according to Embodiment 1 of the present disclosure are provided with the same reference signs, and features identical or corresponding to those according to Embodiment 1 are not described. A storage water heater 3 according to Embodiment 3 is described below with reference to the drawings.

Figure 7:
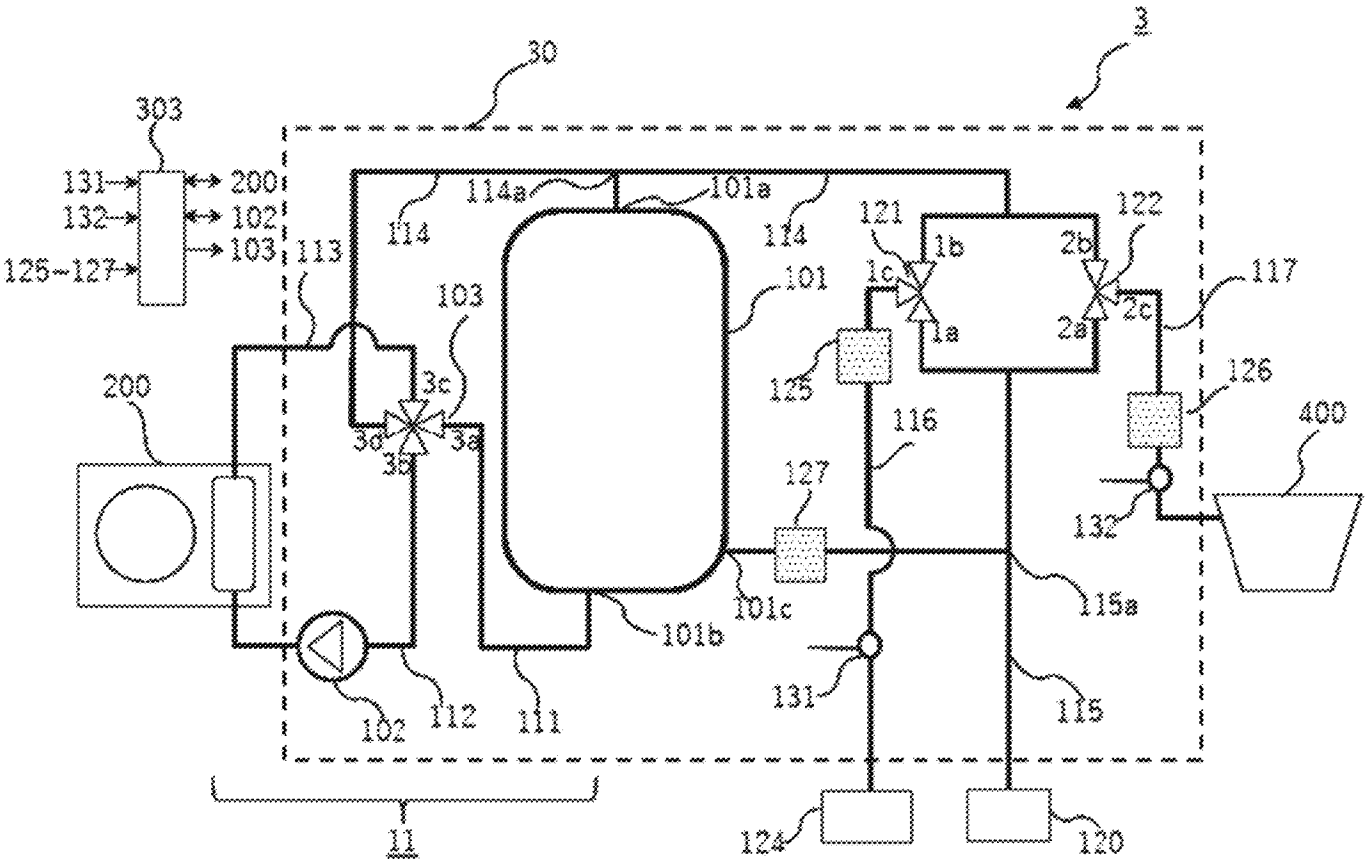
FIG. 7 is a configuration diagram of a storage water heater according to Embodiment 3 of the present disclosure.

FIG. 7 is a configuration diagram of the storage water heater 3 according to Embodiment 3 of the present disclosure. As compared with the storage water heater 1 according to Embodiment 1 illustrated in FIG. 1, the storage water heater 3 according to Embodiment 3 includes a hot-water storage unit 30 (represented by an area surrounded by a dotted line illustrated in FIG. 7) in which flow sensors 125 and 126 are disposed in the hot-water storage unit 30, each of the flow sensors 125 and 126 serving as a water flow detection unit that measures the amount of warm water that is supplied to an external location. Additionally or alternatively, a flow sensor 127 is disposed as a water flow detection unit that measures the amount of tap water that is supplied to the hot-water storage tank 101.

As illustrated in FIG. 7, in the storage water heater 3, the flow sensor 125 is disposed at a point in the sixth passage 116 connected to the hot-water supply end 124, and the flow sensor 126 is disposed at a point in the seventh passage 117 connected to the bathtub 400. The warm water to be supplied to an external location passes through the sixth passage 116 or the seventh passage 117.

The flow sensor 127 is disposed between the branch part 115*a* of the fifth passage 115 connected to the water supply end 120, and the second inlet-outlet port 101*b* of the hot-water storage tank 101. The tap water to be supplied to the hot-water storage tank 101 passes through the fifth passage 115 and the branch part 115*a*. The flow sensor 127 may be disposed at any location other than the above-mentioned location as long as the flow sensor 127 is configured to measure the amount of tap water charged into the hot-water storage tank 101.

All of the flow sensors 125, 126, and 127 may be provided, or only one of these flow sensors may be provided as required.

The storage water heater 3 according to Embodiment 3 includes a controller 303. The controller 303 controls a heat-up operation, a recirculation operation, and the switching action of the four-way valve 103 serving as a switching unit.

A heat-up operation performed by the storage water heater 3 is substantially the same as the heat-up operation performed by the storage water heater 1 according to Embodiment 1, and thus not described below.

As with Embodiment 1, the storage water heater 3 according to Embodiment 3 likewise executes, after the heat-up operation, a recirculation operation in which hot water drawn from the upper part of the hot-water storage tank 101 is delivered to the lower part of the hot-water storage tank 101. The following describes how the recirculation operation performed by the storage water heater 3 according to Embodiment 3 differs from the recirculation operation according to Embodiment 1.

<Recirculation Operation>

In the storage water heater 3 according to Embodiment 3, the controller 303 controls the recirculation operation depending on the amount of tap water that is supplied to the hot-water storage tank 101.

The amount of warm water supplied to an external location at the hot-water supply end 124 is measured by the flow sensor 125 disposed in correspondence with the hot-water supply end 124. At this time, the temperature of warm water is measured by the thermistor 131. The measurement results obtained by the flow sensor 125 and the thermistor 131 are sent to the controller 303. Since a heat quantity is calculated as the product of temperature and the amount of water, the heat quantity of warm water supplied to the hot-water supply end 124 is calculated from the measured amount of warm water and the measured temperature of warm water. The controller 303 thus computes the amount of hot water that has been drawn from the upper part of the hot-water storage tank 101, and estimates the amount of tap water that has been charged into the hot-water storage tank 101.

The amount of warm water supplied to an external location at the bathtub 400 is measured by the flow sensor 126 disposed in correspondence with the bathtub 400. At this time, the temperature of warm water is measured by the thermistor 132. The measurement results obtained by the flow sensor 126 and the thermistor 133 are sent to the controller 303. The heat quantity of warm water supplied to the bathtub 400 is calculated from the measured amount of warm water and the measured temperature of warm water. The controller 303 thus computes the amount of hot water that has been drawn from the upper part of the hot-water storage tank 101, and estimates the amount of tap water that has been charged into the hot-water storage tank 101.

That is, the amount and temperature of warm water supplied to an external location are measured by using each of the flow sensors 125 and 126 as a water flow detection unit and by using each of the thermistors 131 and 132 as a warm-water-temperature detection unit. The heat quantity of warm water supplied to an external location is calculated on the basis of the measurement results of the amount and temperature of warm water, and the amount of hot water that has been drawn from the hot-water storage tank 101 is thus computed. The amount of tap water supplied to the hot-water storage tank 101 is estimated from the amount of hot water that has been drawn from the hot-water storage tank 101.

Alternatively, the amount of hot water that has been drawn from the hot-water storage tank 101 may be directly measured by a flow sensor or other suited sensor.

In a case in which the flow sensor 127 is to be used as a water flow detection unit for tap water, the amount of tap water supplied to the hot-water storage tank 101 is measured directly. The measurement result obtained by the flow sensor 127 is sent to the controller 303.

The controller 303 may calculate the amount of tap water supplied to the hot-water storage tank 101 from measurement information individually obtained by the flow sensors 125, 126, and 127, or may calculate the amount of tap water supplied to the hot-water storage tank 101 more accurately by combining the measurement results obtained by these flow sensors.

According to Embodiment 3, the duration of the recirculation operation is controlled depending on the amount of tap water supplied to the hot-water storage tank 101. More specifically, the controller 303 controls the recirculation operation such that the duration for which the circulation pump 102 is to be operated during the recirculation operation increases with increasing amount of tap water supplied to the hot-water storage tank 101, and that the duration for which the circulation pump 102 is to be operated during the recirculation operation decreases with decreasing amount of tap water supplied to the hot-water storage tank 101.

This makes continuous circulation unnecessary, and allows for reduced duration of the recirculation operation in comparison to Embodiment 1. The controller 303 allows the heat pump unit 200 to be operated depending on the amount of tap water charged into the hot-water storage tank 101. This enables efficient execution of the recirculation operation.

The storage water heater according to Embodiment 3 provides substantially the same advantageous effect as that of the storage water heater according to Embodiment 1.

Further, the recirculation operation is controlled depending on the amount of tap water supplied to the hot-water storage tank. This allows for improved efficiency of the recirculation operation.

Embodiment 4

In the following description of Embodiment 4, components or elements identical to those according to Embodiment 1 of the present disclosure are provided with the same reference signs, and features identical or corresponding to those according to Embodiment 1 are not described. A storage water heater 4 according to Embodiment 4 is described below with reference to the drawings.

Figure 8:
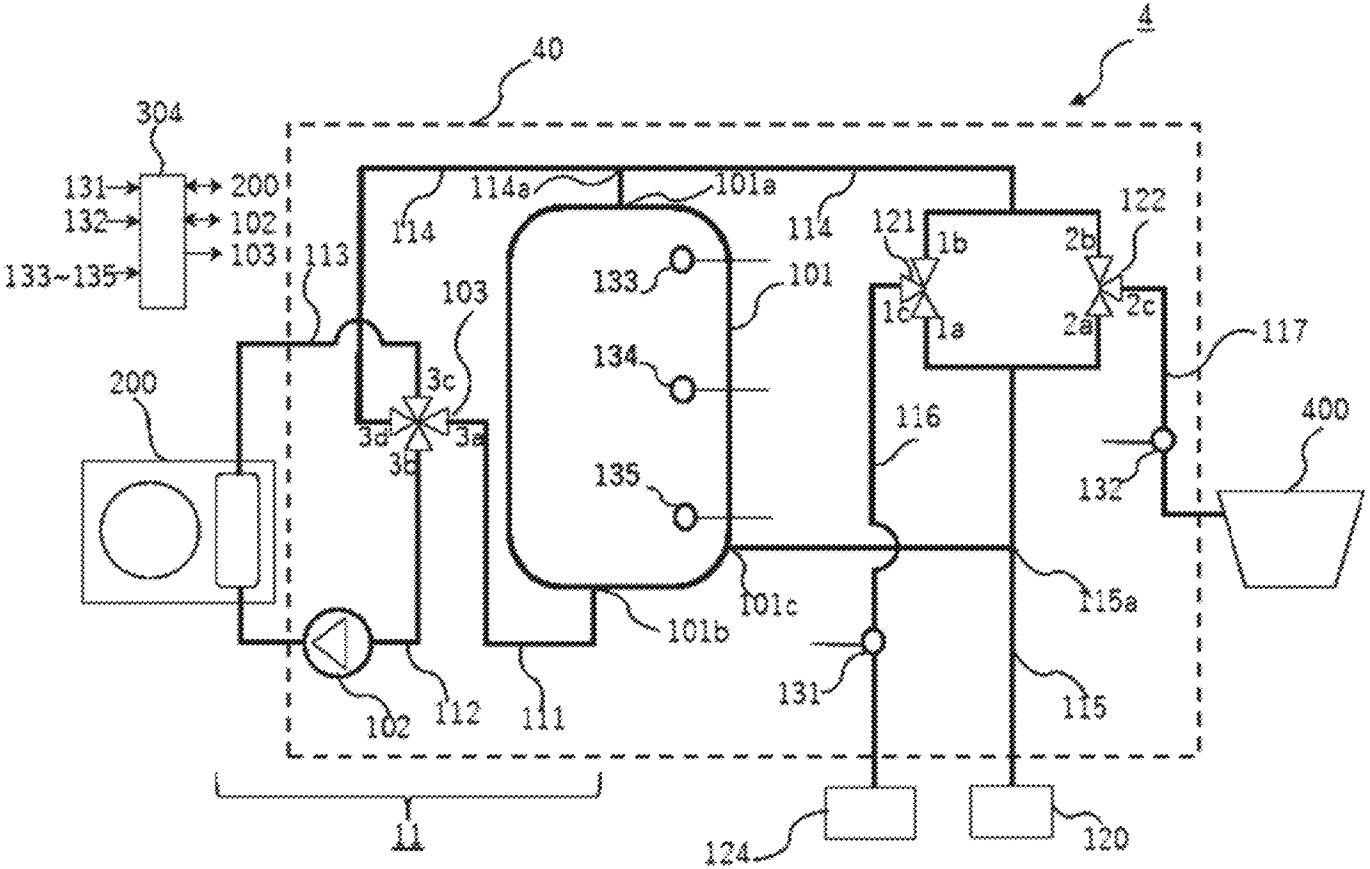
FIG. 8 is a configuration diagram of a storage water heater according to Embodiment 4 of the present disclosure.

FIG. 8 is a configuration diagram of the storage water heater 4 according to Embodiment 4 of the present disclosure. As compared with the storage water heater 1 according to Embodiment 1, the storage water heater 4 according to Embodiment 4 includes a hot-water storage unit 40 (represented by an area surrounded by a dotted line illustrated in FIG. 8) in which thermistors are disposed, each thermistor serving as a hot-water-temperature detection unit that detects the temperature of hot water stored in the hot-water storage tank 101.

As illustrated in FIG. 8, in the hot-water storage tank 101 of the storage water heater 3, multiple thermistors each serving as a hot-water-temperature detection unit are arranged in the up-and-down direction of the hot-water storage tank 101. A thermistor 133 is disposed in the upper part of the hot-water storage tank 101. A thermistor 134 is disposed in the middle part of the hot-water storage tank 101. A thermistor 135 is disposed in the lower part of the hot-water storage tank 101. The thermistors 133, 134, and 135 detect the temperatures in different temperature zones of hot water stored in layers in the hot-water storage tank 101.

Although the thermistors 133, 134, and 135 are illustrated in FIG. 8 as being disposed in the interior of the hot-water storage tank 101, these thermistors may be disposed on the outer wall surface of the hot-water storage tank 101.

The storage water heater 4 according to Embodiment 4 includes a controller 304. The controller 304 controls a heat-up operation, a recirculation operation, and the switching action of the four-way valve 103 serving as a switching unit.

A heat-up operation performed by the storage water heater 4 is substantially the same as the heat-up operation performed by the storage water heater 1 according to Embodiment 1, and thus not described below.

As with Embodiment 1, the storage water heater 4 according to Embodiment 4 likewise executes, after the heat-up operation, a recirculation operation in which hot water drawn from the upper part of the hot-water storage tank 101 is delivered to the lower part of the hot-water storage tank 101. The following describes how the recirculation operation performed by the storage water heater 4 according to Embodiment 4 differs from the recirculation operation according to Embodiment 1.

<Recirculation Operation>

In the storage water heater 4 according to Embodiment 4, the temperature of hot water stored in the hot-water storage tank 101 is detected by each of the thermistors 133, 134, and 135 serving as a hot-water-temperature detection unit, and the temperature detected by each thermistor is sent to the controller 304. The controller 304 controls the recirculation operation depending on the temperature of hot water stored in the hot-water storage tank 101.

The controller 304 is configured to cause the recirculation operation to be continued to keep the temperature of hot water stored in the hot-water storage tank 101 outside a predetermined temperature range. A predetermined temperature range that tends to facilitate microbial growth is defined in advance, and the recirculation operation is executed such that the temperature of stored hot water is outside the predetermined temperature range. For example, the circulation pump 102 is continued to operate to ensure that the temperatures detected by the thermistors 133, 134, and 135 be outside a range of 20 to 40 degrees C.

In a case in which the temperatures detected by the thermistors 133 and 134 drop, and the temperature detected by the thermistor 135 located in the lower part of the hot-water storage tank 101 does not become higher than 40 degrees C. even when the recirculation operation is executed, the controller 304 activates the heat pump unit 200 to enable efficient execution of the recirculation operation.

A thermistor may be disposed only in the lower part of the hot-water storage tank 101 as a hot-water-temperature detection unit to detect the temperature of hot water in the lower part. In this case, the recirculation operation is controlled such that the temperature of hot water in the lower part of the hot-water storage tank 101 is outside the range of 20 to 40 degrees C.

The storage water heater according to Embodiment 4 provides substantially the same advantageous effect as that of the storage water heater according to Embodiment 1.

Further, the recirculation operation is controlled depending on the temperature of hot water in the hot-water storage tank. This leads to improved efficiency of the recirculation operation.

Embodiment 5

In the following description of Embodiment 5, components or elements identical to those according to Embodiment 1 of the present disclosure are provided with the same reference signs, and features identical or corresponding to those according to Embodiment 1 are not described. A storage water heater 5 according to Embodiment 5 is described below with reference to the drawings.

Figure 9:
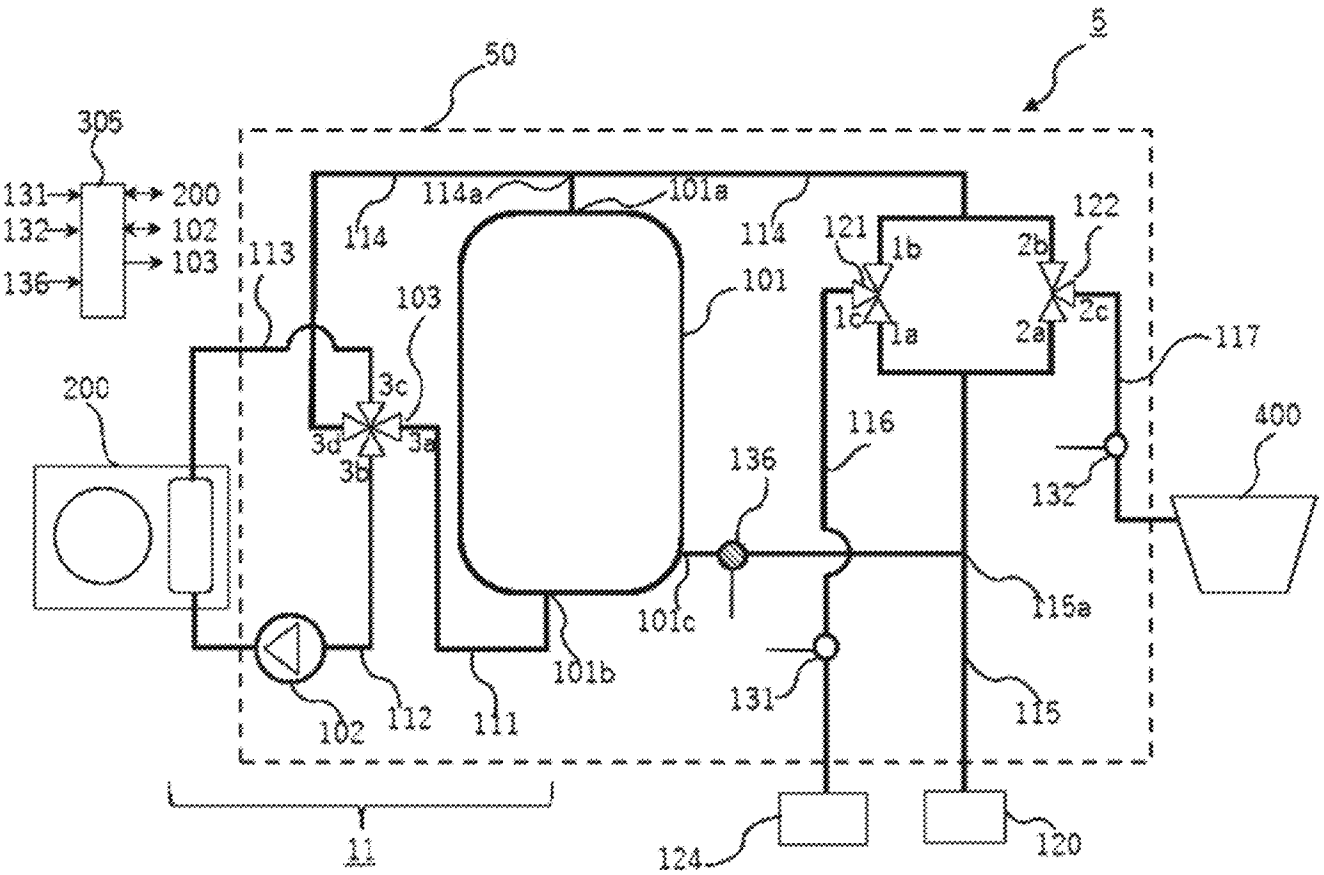
FIG. 9 is a configuration diagram of a storage water heater according to Embodiment 5 of the present disclosure.

FIG. 9 is a configuration diagram of the storage water heater 5 according to Embodiment 5 of the present disclosure. As compared with the storage water heater 1 according to Embodiment 1, the storage water heater 5 according to Embodiment 5 includes a hot-water storage unit 50 (represented by an area surrounded by a dotted line illustrated in FIG. 9) in which a thermistor 136 is disposed in a passage through which tap water is supplied. The thermistor 136 serves as a tap-water-temperature detection unit that detects the temperature of tap water.

As illustrated in FIG. 9, in the storage water heater 5, the thermistor 136 is disposed in the fifth passage 115 through which tap water is supplied. The thermistor 136 is disposed to detect the temperature of tap water supplied to the hot-water storage tank 101. FIG. 9 illustrates an example in which the thermistor 136 is disposed between the branch part 115*a* of the fifth passage 115, and the water supply port 101*c* of the hot-water storage tank 101.

The tap-water-temperature detection unit to be used, and its location are not limited to those mentioned above as long as the temperature of hot water supplied to the hot-water storage tank 101 is detected.

The storage water heater 5 according to Embodiment 5 includes a controller 305. The controller 305 controls a heat-up operation, a recirculation operation, and the switching action of the four-way valve 103 serving as a switching unit.

A heat-up operation performed by the storage water heater 5 is substantially the same as the heat-up operation performed by the storage water heater 1 according to Embodiment 1, and thus not described below.

As with Embodiment 1, the storage water heater 5 according to Embodiment 5 likewise executes, after the heat-up operation, a recirculation operation in which hot water drawn from the upper part of the hot-water storage tank 101 is delivered to the lower part of the hot-water storage tank 101. The following describes how the recirculation operation performed by the storage water heater 5 according to Embodiment 5 differs from the recirculation operation according to Embodiment 1.

<Recirculation Operation>

In the storage water heater 5 according to Embodiment 5, the temperature of tap water supplied to the hot-water storage tank 101 is detected by the thermistor 136 serving as a tap-water-temperature detection unit, and the temperature detected by the thermistor 136 is sent to the controller 305. The controller 305 controls the recirculation operation depending on the temperature of tap water supplied to the hot-water storage tank 101.

More specifically, the controller 305 controls the recirculation operation as described below. The higher the environmental temperature because of the season or other factors, and the higher the temperature of tap water detected by the thermistor 136, the shorter the duration for which the circulation pump 102 is to be operated during the recirculation operation. The lower the environmental temperature because of the season or other factors, and the lower the temperature of tap water detected by the thermistor 136, the longer the duration for which the circulation pump 102 is to be operated during the recirculation operation. In this manner, the duration of the recirculation operation is controlled depending on the detected temperature of tap water. This allows for improved efficiency of the recirculation operation.

The controller 305 may, in response to changes in environmental temperature, activate the heat pump unit 200 when the temperature of tap water is below a predetermined temperature, such as in winter. This enables efficient execution of the recirculation operation.

It is also possible to combine different embodiments with each other. For example, the storage water heater 5 may be used in combination with the thermistors according to Embodiment 4 that are disposed in the interior of the hot-water storage tank 101. In this case, the operation of the circulation pump 102 and the operation of the heat pump unit 200 are controlled depending on the detected temperature of hot water stored in the hot-water storage tank 101 and the detected temperature of tap water supplied to the hot-water storage tank 101. This enables efficient execution of the recirculation operation.

The storage water heater according to Embodiment 5 provides substantially the same advantageous effect as that of the storage water heater according to Embodiment 1.

Further, the recirculation operation is controlled depending on the detected temperature of tap water being supplied. This enables efficient execution of the recirculation operation.

The features described above with reference to the embodiments are representative of one example of the present disclosure. These features may be combined with other known techniques, or different embodiments may be combined with each other. The features may be partially omitted or modified without departing from the spirit and scope of the present disclosure. The above-mentioned embodiments are intended to be illustrative of the present disclosure, rather than restrictive of the scope of the present disclosure.

REFERENCE SIGNS LIST

1, 2, 3, 4, 5: storage water heater, 10, 20, 30, 40, 50: hot-water storage unit, 11, 12: passage, 101: hot-water storage tank, 101*a*: first inlet-outlet port, 101*b*: second inlet-outlet port, 101*c*: water supply port, 102: circulation pump, 103: four-way valve, 104: three-way valve, 105: three-way valve, 111: first passage, 112: second passage, 113: third passage, 114: fourth passage, 115: fifth passage, 116: sixth passage, 117: seventh passage, 120: water supply end, 121, 122: mixing valve, 124: hot-water supply end, 125, 126, 127: flow sensor, 131, 132, 133, 134, 135: thermistor, 136: thermistor, 200: heat pump unit

The invention claimed is:

1. A storage water heater comprising:

a heater;

a hot-water storage tank that stores hot water;

a first passage connected to a lower part of the hot-water storage tank; and a controller configured to selectively switch between a heat-up operation and a recirculation operation, the heat-up operation being an operation in which hot water flowing out from the lower part of the hot-water storage tank is delivered to the heater via the first passage and then hot water heated by the heater is delivered to an upper part of the hot-water storage tank, the recirculation operation being an operation in which hot water flowing out from the upper part of the hot-water storage tank is delivered to the lower part of the hot-water storage tank via the first passage, the hot-water storage tank including a water supply port through which tap water is supplied to the hot-water storage tank, the controller being configured to, on the basis of an amount of the tap water supplied to the hot-water storage tank from the water supply port, vary a duration of the recirculation operation, during the recirculation operation, the hot-water flowing out from the upper part of the hot-water storage tank being delivered to the lower part of the hot-water storage tank through the heater, the storage water heater further comprising:

a switch;

a second passage that connects the switch and an inlet portion of the heater to each other;

a third passage that connects an outlet portion of the heater and the switch to each other;

a fourth passage that connects the switch and the upper part of the hot-water storage tank to each other; and a circulator disposed in the second passage or in the third passage, the circulator being configured to form a flow of hot water that travels from the inlet portion of the heater toward the outlet portion of the heater, wherein the first passage connects the lower part of the hot-water storage tank and the switch to each other, wherein the switch is configured to selectively switch between a heat-up operation state and a recirculation operation state, the heat-up operation state being an operation state in which the first passage and the second passage communicate with each other and in which the third passage and the fourth passage communicate with each other, the recirculation operation state being an operation state in which the fourth passage and the second passage communicate with each other and in which the third passage and the first passage communicate with each other, and wherein the controller is configured to, in the heat-up operation, control the switch to the recirculation operation state, and is configured to, in the recirculation operation, control the switch to the recirculation operation state.

2. The storage water heater of claim 1, wherein, in the recirculation operation, the hot water flowing out from the upper part of the hot-water storage tank is heated by the heater before the hot water is delivered to the lower part of the hot-water storage tank via the first passage.

3. The storage water heater of claim 1, wherein the controller is configured to, in both the heat-up operation and the recirculation operation, activate the circulator to form the flow of hot water that travels from the inlet portion of the heater toward the outlet portion of the heater.

4. The storage water heater of claim 1, wherein the switch is a four-way valve, the four-way valve including a first water inlet-outlet port, a second water inlet-outlet port, a third water inlet-outlet port, and a fourth water inlet-outlet port, wherein the first water inlet-outlet port of the four-way valve and the first passage are connected to each other, wherein the second water inlet-outlet port of the four-way valve and the second passage are connected to each other, wherein the third water inlet-outlet port of the four-way valve and the third passage are connected to each other, and wherein the fourth water inlet-outlet port of the four-way valve and the fourth passage are connected to each other.

5. The storage water heater of claim 1, wherein the switch includes two three-way valves, the two three-way valves each including a first water inlet-outlet port, a second water inlet-outlet port, and a third water inlet-outlet port, wherein the first water inlet-outlet port of each of the two three-way valves and the first passage are connected to each other, wherein the second water inlet-outlet port of one of the two three-way valves and the second passage are connected to each other, wherein the second water inlet-outlet port of an other one of the two three-way valves and the third passage are connected to each other, and wherein the third water inlet-outlet port of each of the two three-way valves and the fourth passage are connected to each other.

6. The storage water heater of claim 1, wherein the controller is configured to increase the duration of the recirculation operation as the amount of the tap water supplied to the hot-water storage tank increases and is configured to decrease the duration of the recirculation operation as the amount of the tap water supplied to the hot-water storage tank decreases.

7. The storage water heater of claim 1, wherein the amount of the tap water is estimated from an amount of hot water that has been drawn from the hot-water storage tank.

8. The storage water heater of claim 7, wherein the amount of the hot water that has been drawn from the hot-water storage tank is computed on the basis of a heat quantity of warm water that is supplied to an external location.

9. The storage water heater of claim 8, further comprising:

a water flow detector configured to measure an amount of the warm water; and a warm-water-temperature detector configured to measure a temperature of the warm water, wherein the heat quantity of the warm water is calculated from the amount of the warm water and the temperature of the warm water.

10. The storage water heater of claim 1, wherein the controller includes a hot-water-temperature detector configured to detect a temperature of hot water stored in the hot-water storage tank, and wherein the controller is configured to, depending on the temperature of the hot water stored in the hot-water storage tank detected by the hot-water-temperature detector, cause the recirculation operation to be continued to keep the temperature of the hot water stored in the hot-water storage tank outside a predetermined temperature range.

11. The storage water heater of claim 10, wherein the hot-water-temperature detector comprises a plurality of thermistors arranged in an up-and-down direction of the hot-water storage tank and configured to detect the temperature of the hot water stored in the hot-water storage tank.

12. The storage water heater of claim 1, wherein the controller includes a tap-water-temperature detector configured to detect a temperature of tap water that is supplied to the hot-water storage tank, and wherein the controller is configured to, depending on the temperature of the tap water, decrease a duration of the recirculation operation as the temperature of the tap water increases, and increase a duration of the recirculation operation as the temperature of the tap water decreases.

13. The storage water heater of claim 12, wherein the tap-water-temperature detector comprises a thermistor disposed between a water supply end and the hot-water storage tank and configured to detect the temperature of the tap water, the water supply end being an end through which the tap water is supplied.

14. The storage water heater of claim 1, wherein:

during the recirculation operation, water is not recirculated through a pipe directly connected to a fixture which draws hot water.

* * * * *